United States Patent [19]

Wolocko

[11] Patent Number: 4,483,328

[45] Date of Patent: Nov. 20, 1984

[54] CHIROPRACTIC INSTRUMENT

[76] Inventor: Roman A. Wolocko, 5881 Larkins, Detroit, Mich. 48210

[21] Appl. No.: 389,610

[22] Filed: Jun. 18, 1982

[51] Int. Cl.[3] ..... A61H 7/00

[52] U.S. Cl. ..... 128/67; 128/61

[58] Field of Search ..... 128/67, 60, 61, 62 R, 128/69; 273/425, 426, 129 K; 81/3 R; D24/23, 30, 36

[56] References Cited

U.S. PATENT DOCUMENTS

| | | | |
|---|---|---|---|
| 655,490 | 8/1900 | Hollem | 128/60 |
| 2,447,698 | 8/1948 | Haberer | 128/69 |
| 3,565,435 | 2/1971 | Liston | 273/426 |
| 3,679,209 | 7/1972 | Wexstaff | 273/129 K |
| 4,203,249 | 5/1980 | Böhm | 273/425 |
| 4,336,706 | 6/1982 | Garcia | 81/3 R |

FOREIGN PATENT DOCUMENTS

| | | | |
|---|---|---|---|
| 919701 | 3/1947 | France | 273/426 |
| 10702 | 6/1895 | Switzerland | 128/62 R |

*Primary Examiner*—Richard J. Apley
*Assistant Examiner*—Harry Macey
*Attorney, Agent, or Firm*—Barnes, Kisselle, Raisch, Choate, Whittemore & Hulbert

[57] ABSTRACT

A chiropractic instrument for applying therapeutic pressure consisting of a one-piece integral structure having a planar star-like configuration which includes three legs radiating from a central hub and adapted to be grasped and used in various orientations to simulate thumb, knuckle and finger pressure on the patient's body.

3 Claims, 5 Drawing Figures

FIG.1
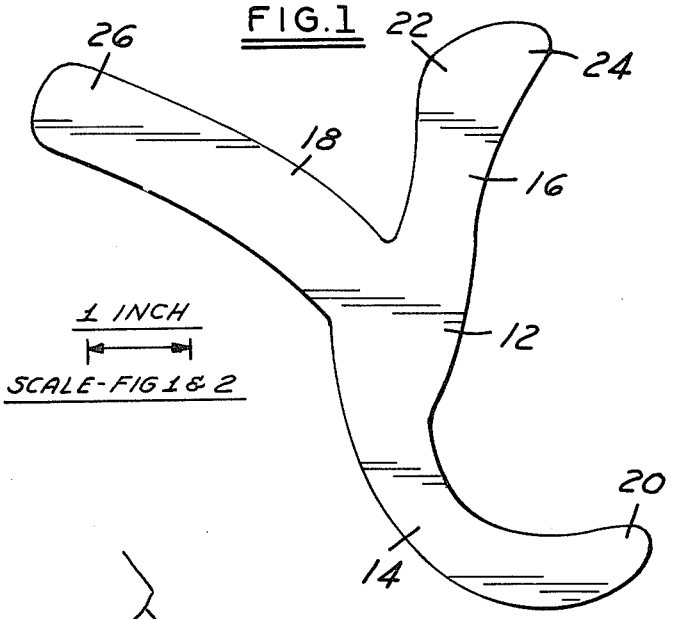
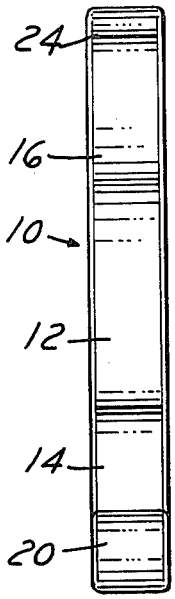
FIG.2
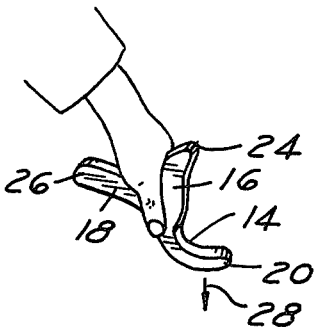
FIG.3
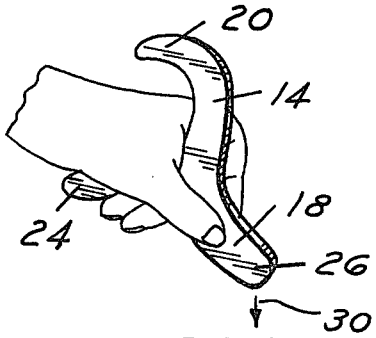
FIG.4
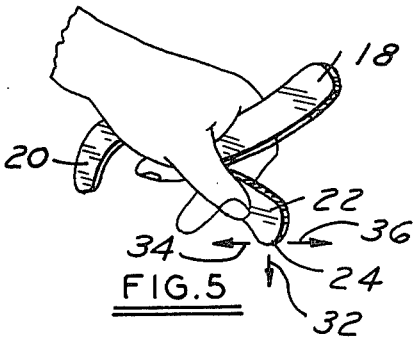
FIG.5

CHIROPRACTIC INSTRUMENT

The present invention is directed to implements adapted to be used by a therapist or the like for selectively applying force or pressure to parts of the body, particularly the spinal region, so as to effect adjustment of the underlying joints and tissues.

An object of the present invention is to provide a simple and economical instrument of the described type which may be used by the therapist with substantially less effort than is the case with present practice where fingers, thumbs or knuckles are pressed against the patient's body, and which thus reduces the therapist fatigue problem which presently exists in the art.

Another object of the invention is to provide an instrument of the described type which is adapted in various orientations to apply pressure of different concentrations and for different manipulative purposes.

A further object of the invention is to provide a one-piece instrument of the described type which may be readily transported by the therapist and employed at any suitable location.

The invention, together with additional objects, features and advantages thereof, will be best understood from the following description, the appended claims and the accompanying drawings in which:

FIG. 1 is a side elevational view of a presently preferred embodiment of the invention at drawn to scale;

FIG. 2 is an end view of the implement shown in FIG. 1 drawn to the same scale; and FIGS. 3–5 are schematic illustrations of the invention in use in various orientations.

Referring to FIGS. 1 and 2, the presently preferred embodiment 10 of a chiropractic instrument in accordance with the invention is illustrated to scale as comprising a one-piece integral implement of planar configuration and finite thickness. Instrument 10 is of generally star-shaped configuration, possessing a central hub 12 with three legs 14, 16, 18 projecting radially outwardly therefrom. The hub-remote end 20 of leg 14 is curled in the plane of instrument 10 (FIG. 2) at about the radius of curvature of an adult human thumb that is bent backwardly toward the forearm by pressure against a surface. Leg 16 projects from hub 12 oppositely of leg 14 and terminates in a widened end 22 which tapers to a rounded point 24 oriented substantially parallel to the tip of leg 14. End 22 of leg 16 is thus configured to approximate the dimensions of typical adult forefinger which is bent inwardly upon itself, with leg tip 24 being the first knuckle.

Third leg 18 radiates from hub 12 at an acute angle with respect to leg 16 and is slightly arcuate in the direction of leg 14. Leg 18 is of generally uniform cross sectional dimension throughout and terminates in a rounded tip 26 of large radius of curvature. The tip of leg 18 approximates the dimensions of an adult human forefinger which is bent outwardly as by pressing downwardly on a surface with the finger rigid. As best appreciated with reference to FIG. 2, the entirety of instrument 10 is contained between flat parallel sides, such that a cross section taken any where through the implement perpendicular to the instrument side surfaces would be of rectangular configuration. The instrument 10 is of a size adapted to be easily grasped and used by hand, as will be described in connection with FIGS. 3–5. Preferably, instrument 10 is cut or molded of integral plastic material with edges radiused, as shown in FIG. 2.

It will thus be appreciated that the configuration of the legs of instrument 10 simulate the three finger orientations most commonly used by a chiropractic therapist—i.e. thumb pressure (leg 14), finger tip pressure (leg 18) and knuckle pressure (leg 16). FIGS. 3–5 illustrate various orientations in which the instrument may be used. FIG. 3 in particular shows the instrument in an orientation for applying thumb pressure, which has significant therapeutic benefits in many cases but is quite fatiguing for the therapist to maintain for a long period of time. For this application, leg 18 is grasped in the closed hand with leg 16 projecting over the top of the hand toward the wrist and forearm. Leg 14 thus projects as an extension of the user's arm in an orientation such that leg end 20 simulates the thumb. Pressure may then be applied in the downward direction 28, assisted where necessary by placement of the therapist's other hand on leg 22 for added pressure.

For application of more concentrated pressure, the instrument is rotated and grasped as shown in FIG. 4 about the bridge between legs 14, 16, with leg 14 projecting forwardly and leg 18 projecting downwardly. Leg 18 may thus be used to apply pressure in the direction 30, assisted where desired by placement of the therapist's other hand over the instrument-grasping hand. FIG. 5 illustrates use of knuckled leg 22 for applying either concentrated pressure in the direction 32, or separating pressure in the direction 34 or 36. It will be appreciated that other instrument orientations may be used by the therapist where desired.

The invention claimed is:

1. A chiropractic instrument adapted to be manually employed by a therapist for applying pressure to selected surface portions of a patient's body so as to effect adjustment of underlying joints and tissues, said instrument being a substantially rigid flat member consisting of a central hub portion and three legs wherein the first leg integrally extends from said hub portion in an arc at substantially constant first radius of curvature and terminates in a blunt rounded first tip, the second leg integrally extends from said hub portion oppositely of said first leg, said second leg terminates in a widened end which tapers to a blunt rounded second tip oriented substantially parallel to said rounded first tip, and the third leg integrally extends from said hub portion at an acute angle with respect to said second leg, said third leg being arcuate in the direction of said first leg at a second substantially constant radius of curvature which is greater than said first radius of curvature, said third leg being of substantially uniform cross section throughout its length and terminating in a rounded blunt third tip, said first, second and third legs being coplanar with said hub portion, whereby one can selectively utilize said first leg for applying simulated thumb pressure, said third leg for applying more concentrated pressure and said second leg for applying concentrated or separating pressure.

2. The chiropractic instrument set forth in claim 1 wherein said rounded second tip has a radius of curvature which is less than the radius of curvature of said rounded third tip.

3. The instrument set forth in claims 1 or 2 wherein said instrument, including said hub portion and said legs, has parallel planar side surfaces and is of uniform thickness between said side surfaces.

* * * * *